United States Patent [19]

Witt

[11] Patent Number: 4,795,137

[45] Date of Patent: Jan. 3, 1989

[54] FLANGED FENCE POST

[76] Inventor: Samuel Witt, P.O. Box 265, Fishersville, Va. 22939

[21] Appl. No.: 81,365

[22] Filed: Aug. 4, 1987

[51] Int. Cl.[4] ..... E04H 17/00

[52] U.S. Cl. ..... 256/1; 256/DIG. 5; 52/154

[58] Field of Search ..... 52/153, 154, 165, 156; 256/DIG. 5, 1

[56] References Cited

U.S. PATENT DOCUMENTS 269,844 1/1883 fox ..... 52/165

3,342,444 9/1967 Nelson ..... 52/154 X

FOREIGN PATENT DOCUMENTS 2343877 10/1977 France ..... 256/DIG. 5

*Primary Examiner*—Andrew V. Kundrat

*Attorney, Agent, or Firm*—Richard C. Litman

[57] ABSTRACT

This device relates to tubular fence posts having a plurality of triangularly flanged fins, radially disposed about the lower portion of the post. The triangular flanges substantively extend below a planar terminal end of the post such that triangular tip extensions are formed thereby. The tip extensions are disposed horizontally below the planar terminal end of the post. The upper edge of the triangular flanges extend longitudinally up the post to a point substantively consisting of a ratio 2:5 of the length of post above the upper edge of the triangular flanges.

1 Claim, 1 Drawing Sheet

FLANGED FENCE POST

FIELD OF INVENTION

This apparatus relates to fencing and especially to a type of fencing as is used in industrial or institutional applications such as highway fencing.

BACKGROUND TO THE INVENTION

The present device relates to fence posts and more specifically, to those fence posts that are usually made of a metallic substance and being tubular in cross-sectional construction.

Efforts to improve on the ease of installation and on the economy of these posts have been extensive and on-going. Economy is a driving factor in the installation of almost any fencing project.

These efforts to arrive at a greater economy in the installation of fencing has two inherent conditions. The first factor is the usage and wastage of materials as it applies to the amount of material that needs to be buried in the ground to substantively support the post and resist the stresses that are placed on it.

The second factor is the labor required to install the post. Labor taking the form of man-hours required in a typical post installation operation. Typically, most fence posts require the post to be driven a part of the way into soil, then the workmen must measure with a tape the amount of post yet to be driven.

These various steps, such as measuring and checking the vertical alignment with a plumb-line all add to the time required in installing such a fence post.

The present device relates to such posts and in particular those having flared extensions or fins radially affixed about the longitudinal axis of the post.

The novel design fence post, as herein described, has been approved and used by the Virginia Department of Highways and Transportation and has had considerable success in saving both man-hours and materials. In tests conducted this new post was driven into the ground by hand in two minutes.

DESCRIPTION OF THE PRIOR ART

The following U.S. Patents are found which relate to fence posts and as such are exemplary of the U.S. prior art.

U.S. Pat. No. 204,565 to Dickens discloses a fence post that has finned anchoring members for both a post and a brace.

U.S. Pat. No. 3,066,477 to Reitherer et al shows a Potted Plant Holder, also with finned anchoring members attached to the stake of the device.

U.S. Pat. No. 3,302,347 to Jackson is for Drive Anchors with Retaining Flukes. This patent teaches a method of making ground anchors which are implanted in the ground and resist coming loose because of their design, which also incorporates finned member construction.

U.S. Pat. No. 291,927 to Newton discloses four finned members affixed to a solid tubular post, the finned members coming to a point at the end of the post.

U.S. Pat. No. 204,565 to Hartley, prior to Newton, discloses finned members, extending downward from a metallic post, which is triangular in cross section, and forming a point thereby at the end of the post.

U.S. Pat. No. 2,351,261 to Hall illustrates a device constructed of formed metallic members.

DESCRIPTION OF THE PREFERRED EMBODIMENT

Figure 1:
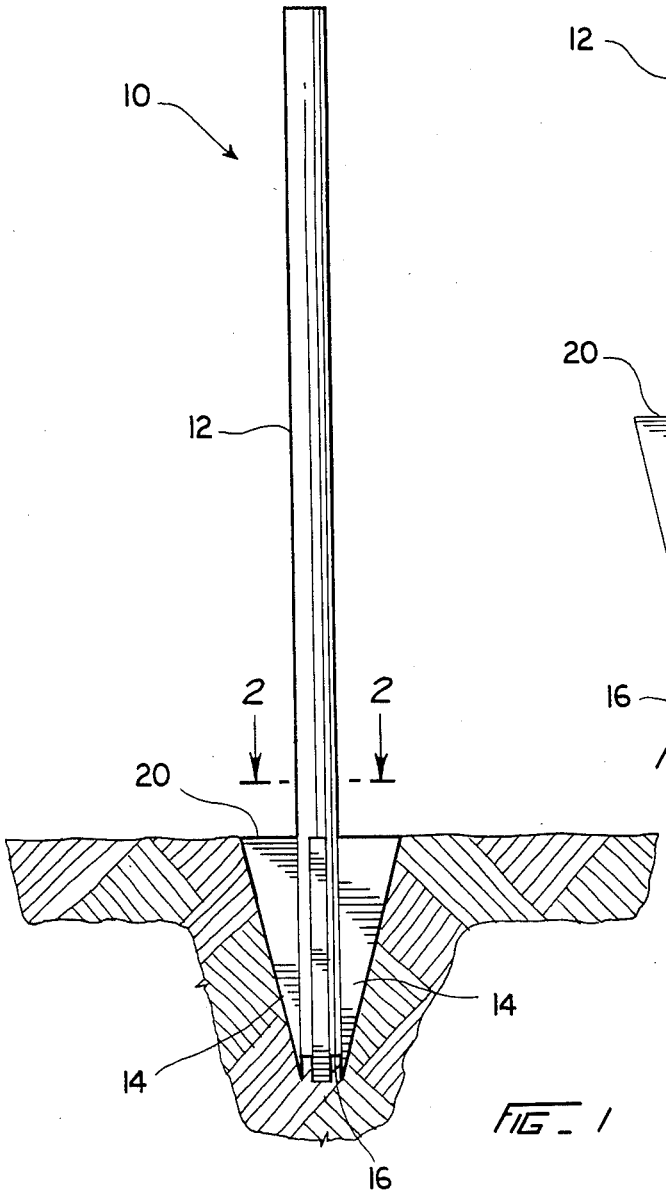
FIG. 1 is an elevational view illustrating the post installed in the earth.

Referring now to the drawings in which like numerals refer to like elements of the invention, device 10 consists of a tubular fence post 12 having four triangular shaped diametrically opposed flanges 14, radially affixed to the lower or driving end of tubular fence post 12.

Figure 3:
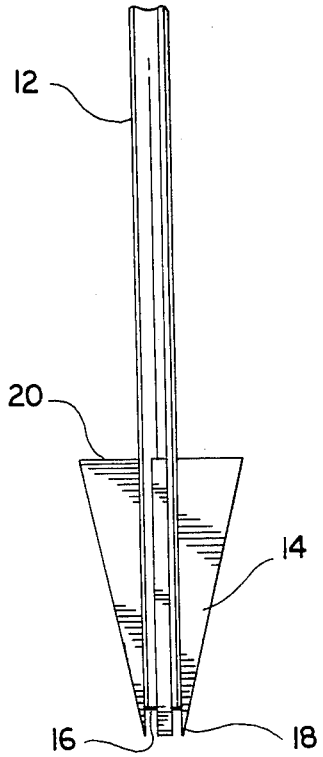
FIG. 3 is an elevational view of an alternate embodiment of the post having tip extensions.
Figure 2:
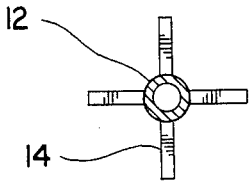
FIG. 2 is a sectional view through 2—2 of FIG. 1.

As seen in FIG. 3, there is shown tubular fence post 12 containing a planar terminal end 16. Triangular flanges 14 are substantially disposed horizontally below planar terminal end 16 such that the tips of the triangular flanges form tip extension 18, the tip extension 18 each of which is spaced from each diametrically opposed flange's extension dimensionally by the outside diameter of the fencepost encounter the earth first during installation of a fence post.

Triangular flanges 14 insert partially into the earth, with planar terminal end 16 sitting on the surface of the earth such that the post is balanced and substantively in a plumb or is vertically disposed relative to the ground line. This simplifies the installation process thereby reducing the number of steps and the amount of time required to install the post.

Triangular flanges 14 have a substantive common length, with the longitudinal axis of the tubular fence post 12 to which the triangular flanges 14 are radially attached. The length of the line of attachment with the tubular fence post 12 forming a ratio of the length to the length of tubular fence post 12 that extends upward to the upper terminal end of the post 12. Triangular flanges 14 form a 2:5 ratio such that if common attachment length of the flanges 14 is two feet, the length of tubular fence post 12 extending above the upper edge 20 of triangular flanges 14 is five feet.

As tubular fence post 12 is installed, the upper triangular edge 20 of flange 14 is disposed horizontally with the surrounding earth of the installation site.

The upper triangular edge 20 provides a visual reference for the installation of tubular fence post 12 in that workmen see when the post 12 has been sufficiently installed. This eliminates the steps in installation, whereby measuring with a tape and such, the length of post installed and the length of post yet to be driven.

Disposing the upper edge 20 of triangular flanges 14 level with the surface of the earth provides for obtaining the greatest resistance to forces acting laterally to the vertical plane of the tubular fence post 12. The lateral forces act to concentrate the force at the juncture of post and soil surface, in that the post offers no resistance whatsoever at any point above the soil surface. In tests, posts constructed and installed according to this disclosure have withstood lateral forces in excess of 3000 pounds.

What is claimed is:

1. A fence post comprising;

a tubular post; said tubular post having a plurality of triangular diametrically opposed flanges rigidly affixed to the lower portion thereof; said triangular flanges being equally spaced about a longitudinal axis of said post; said triangular flanges radially disposed from point of attachment with said post;

said triangular flanges each having an upper edge; said upper edge horizontally disposed with the surface of earth as said post is installed therein; said upper flange edges visible as said tubular post is installed to a proper depth in the earth;

said triangular flanges having a substantive common length with a longitudinal axis parallel to said tubular fence post; said triangular flanges having a substantive ratio to the longitudinal axis of said tubular fence post of 2:5 as measured along said common length of said triangular flange to said tubular fence post whereby an installer is aided in installation thereof by said triangular flanges as the upper edges thereof are visible as said post is installed to a proper depth, and further as said triangular flanges allow said post to be driven easily;

said tubular post having a lowermost planar terminal end;

said diametrically opposed triangular flanges each having a lowermost terminal tip extension spaced dimensionally by one outside diameter of the fence post from the lower terminal tip extension of the opposed flange; said triangular flange lowermost terminal tip extensions being substantially disposed horizontally below said lowermost planar terminal end of said tubular fence post whereby said triangular flange tip extensions penetrate into said earth as said tubular fence post is set prior to installation of said tubular fence post; and whereby said tubular fence post is selfstabilized prior to final installation of said tubular fence post.

* * * * *